United States Patent [19]

Fürst et al.

[11] Patent Number: 4,648,320

[45] Date of Patent: Mar. 10, 1987

[54] DETONATOR TRIGGERING DEVICE

[75] Inventors: Wilhelm Fürst, Buchberg; Werner Rüdenauer, Roth; Rainer Siebert, Rothenbach, all of Fed. Rep. of Germany

[73] Assignee: Diehl GmbH & Co., Nuremberg, Fed. Rep. of Germany

[21] Appl. No.: 715,901

[22] Filed: Mar. 26, 1985

[30] Foreign Application Priority Data

Apr. 19, 1984 [DE] Fed. Rep. of Germany ..... 3414841

[51] Int. Cl.[4] ..... F42C 11/02; F42C 19/04; F42B 19/34

[52] U.S. Cl. ..... 102/210; 102/399; 114/20.1

[58] Field of Search ..... 102/210, 399; 114/20 R, 114/20 A

[56] References Cited

U.S. PATENT DOCUMENTS

| | | | |
|---|---|---|---|
| 2,892,411 | 6/1959 | Brown et al. | 102/210 |
| 3,202,100 | 8/1965 | Vilbajo | 102/210 |
| 4,241,662 | 12/1980 | Rudenauer et al. | 102/210 |

FOREIGN PATENT DOCUMENTS

| | | | |
|---|---|---|---|
| 2535748 | 2/1977 | Fed. Rep. of Germany | 102/210 |

*Primary Examiner*—Charles T. Jordan

*Attorney, Agent, or Firm*—Scully, Scott, Murphy & Presser

[57] ABSTRACT

A detonator triggering device which is located in the head of an underwater projectile, and wherein a pressure receiver which is positioned within an opening in the projectile head is exposed to a dynamic pressure or velocity head. A piezo-ceramic disc which is equipped with electrical contacts is rigidly supported on one side thereof in the head of the projectile, and with its other side contacts against a pressure transmitting member which is supported within the opening in the head. As a result, the dynamic pressure will act against the piezo-ceramic disc. Every change in the dynamic pressure consequently provides for a corresponding change in the charge or change in the voltage of the piezo-ceramic disc. This permits itself to be processed in an electronic evaluating or gating circuit, such that the applicable voltage change is employed as the actuating criteria.

4 Claims, 2 Drawing Figures

DETONATOR TRIGGERING DEVICE

BACKGROUND OF THE INVENTION

1. Field of the Invention

The present invention relates to a detonator triggering device which is located in the head of an underwater projectile, and wherein a pressure receiver which is positioned within an opening in the projectile head is exposed to a dynamic pressure or velocity head.

2. Discussion of the Prior Art

A detonator triggering device of this type is described in German Laid-Open Patent Application No. 31 33 364. In that instance, the pressure receiver has a load imparted thereto through the intermediary of a spring such that, at a sufficient speed of the projectile below water, a switch is held open by the dynamic pressure. Upon penetrating through the surface of the water, the switch will close as a result of the change in the dynamic pressure. As a consequence, this will trigger the detonation. In order to be able to securely activate the switch, it is necessary to have a certain extent of displacement of the pressure receiver relative to the head of the projectile. This leads to sealing problems inasmuch as, on the one hand, the pressure receiver must be movable relative to the head, and on the other hand, it must be sealed with respect to the head. The last-mentioned is already because it is otherwise on both sides thereof exposed to water.

The point in time of the actuation the device pursuant to the German Laid-Open Patent Application No. 31 33 364 depends upon the spring characteristic. This effectually limits its capability or range of utilization since, for example, it is not possible to utilize impact against a target as the switching criteria with such a device when the device is designed to trigger upon leaving the water.

In the disclosure of German Laid-Open Patent Application No. 31 33 364 the response sensitivity depends upon the spring. Consequently, it is only more or less coarsely adjustable and, in particular, can hardly be further adjusted thereafter.

SUMMARY OF THE INVENTION

Accordingly, it is an object of the present invention to provide a device or pressure transducer of the above-mentioned type which facilitates a more ready correlation with different kinds of utilization.

Inventively, the foregoing object is achieved through the intermediary of a device of the above-mentioned type, in which a piezo-ceramic disc which is equipped with electrical contacts is rigidly supported on one side thereof in the head of the projectile, and with its other side contacts against a pressure transmitting member which is supported within the opening in the head. As a result, the dynamic pressure will act against the piezo-ceramic disc. Every change in the dynamic pressure consequently provides for a corresponding change in the electrical charge or change in the voltage of the piezo-ceramic disc. This permits itself to be processed in an electronic evaluating or gating circuit, such that the applicable voltage change is employed as the actuating criteria. It is possible to contemplate the exit from the water, the entry into the water and/or the impact of the projectile, as the switching criteria for initiating the detonation.

A further advantage of the inventive detonator triggering device consists of that it does not incorporate any movable parts. Consequently, the device can also be sealed in a simple manner.

BRIEF DESCRIPTION OF THE DRAWINGS

Advantageous embodiments of the invention can now be ascertained from the following detailed description of an exemplary embodiment thereof, taken in conjunction with the accompanying drawings; in which.

DETAILED DESCRIPTION

Figure 1:
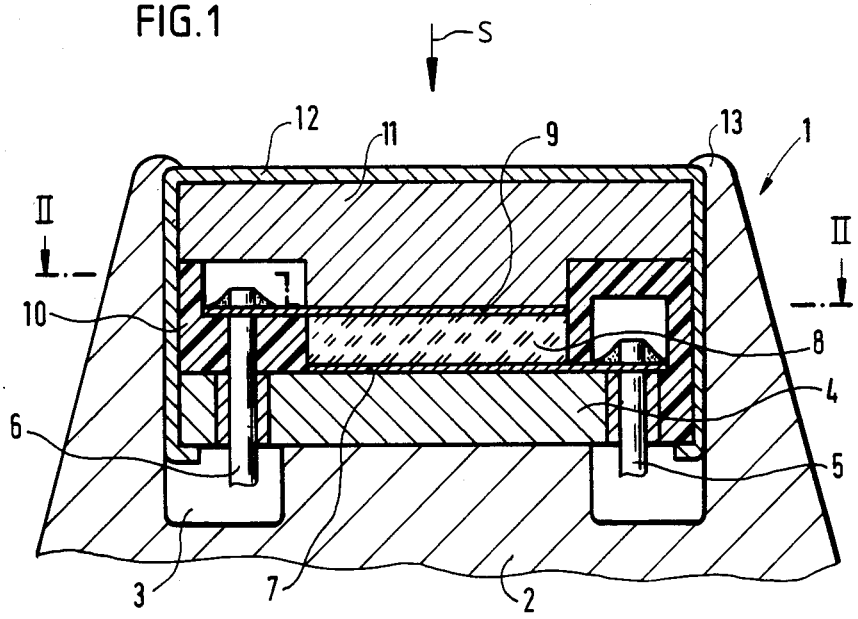
FIG. 1 illustrates a longitudinal section through the head of an underwater projectile.
Figure 2:
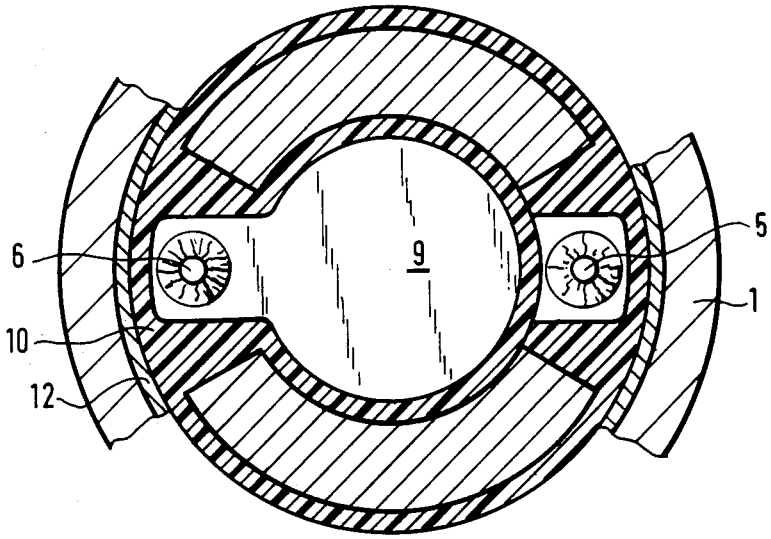
FIG. 2 illustrates a transverse sectional view taken along line II—II in FIG. 1.

A socket pedestal 2 is formed in a projectile head 1 which is encompassed by a ring-shaped or annular space 3.

Seated on the pedestal 2 is a plate 4 through which there are conducted electrical contact pins 5 and 6. The contact pin 5 is soldered to an electrically-conductive foil 7 which lies on the plate 4 and is connected with one side of a piezo-ceramic disc 8. Arranged on the opposite side of the piezo-ceramic disc 8 is an electrically-conductive foil 9 which is soldered to the contact pin 6. Positioned to extend along the circumference of the piezo-ceramic disc 8 is a compressible insulating element 10. This element supports the piezo-ceramic disc 8 in the radial direction.

Seated on the foil 9 is a rigid pressure transmitting member 1 which extends over the insulating member 10. A protective casing 12 covers the pressure transmitting member 11 and extends over the latter, the insulating member 10 and the plate 4. In the area of the annular space 3, the protective casing 12 is flanged inwardly.

The protective casing 12 is extended over by an edge or lip 13 of the projectile head 1. The protective casing 12 is thereby retained in a fixed and water-tight manner within the projectile head 1. Concurrently fixed in position thereby are also the components which are subordinate thereto, between the edge 13 and the pedestal 2.

When the projectile travels below water, a dynamic pressure acts through the protective casing 12 against the pressure transmitting member 11 in the direction of the arrow S. This pressure propagates to the piezo-ceramic disc 8, such that an electrical voltage can be picked up at the contact pins 5 and 6. When the projectile leaves the water, the dynamic pressure will reduce significantly. Conformingly, there will change the voltage which can be picked up between the contact pins 5 and 6. This voltage allows itself to be employed as the switching criterium for an electronic detonating circuit (not shown).

When the projectile strikes against a target, then the pressure acting on the piezo-ceramic disc 8 rises in contrast with the heretofore reigning dynamic pressure. The therewith interrelated voltage change can also be utilized for the detonation.

When the projectile submerges into water from the air, then the dynamic pressure will increase significantly. Also the voltage change interrelated therewith can be employed for the detonation.

What is claimed is:

1. In a detonator triggering device which is located in the head of an underwater projectile, said projectile having an opening in the head; and a pressure receiver positioned within the opening so as to be exposed to a dynamic pressure; the improvement comprising: a piezo-ceramic disc including electrical contacts being rigidly supported on one side thereof within said projectile head; a pressure transmitting member arranged within the opening in the head contacting the opposite side of the piezo-ceramic disc; a plate supporting the piezo-ceramic disc on the side of the disc opposite the pressure transmitting member, said plate including contact pins proximate the piezo-ceramic disc which are connected with the contacts; and a protective casing commonly encompassing the pressure transmitting member, the piezo-ceramic disc and the plate, said protective casing being retained within the projectile head.

2. A detonator triggering device as claimed in claim 1, wherein the contacts each comprise foils, one said foil being positioned intermediate the piezo-ceramic disc and the pressure transmitting member and the other foil intermediate the piezo-ceramic disc and the plate.

3. A detonator triggering device as claimed in claim 1, wherein an insulating member extends along the circumference of the piezo-ceramic disc, said insulating member being positioned between the plate and the pressure transmitting member.

4. A detonator triggering device as claimed in claim 1, wherein the protective casing ends in an annular space in said head, said space encompassing a pedestal on which the plate is seated.

* * * * *